US006816130B1

(12) United States Patent
Shishido et al.

(10) Patent No.: US 6,816,130 B1
(45) Date of Patent: Nov. 9, 2004

(54) DISPLAY APPARATUS FOR USE IN ATHLETIC GAMES

(75) Inventors: Hideomi Shishido, Hiroshima (JP); Yukinori Nagao, Hatsukaichi (JP); Masayuki Tanaka, Hiroshima (JP); Katsumi Kobayashi, Hiroshima (JP); Mitsuo Koyama, Hiroshima (JP); Norihiro Yuki, Hiroshima (JP)

(73) Assignee: Molten Corporation, Hiroshima (JP)

( * ) Notice: Subject to any disclaimer, the term of this patent is extended or adjusted under 35 U.S.C. 154(b) by 0 days.

(21) Appl. No.: 09/482,512

(22) Filed: Jan. 14, 2000

(30) Foreign Application Priority Data

Jan. 18, 1999 (JP) ..... 11-009201

(51) Int. Cl.[7] ..... G09G 5/00

(52) U.S. Cl. ..... 345/2.3; 345/1.2; 345/1.3

(58) Field of Search ..... 345/1.3, 1.2; 273/148 B; 313/519; 463/25, 46, 30–33; 340/323 R, 691.6, 815.42, 815.44, 815.45, 815.47–815.49, 53, 59, 86

(56) References Cited

U.S. PATENT DOCUMENTS

| | | | | | |
|---|---|---|---|---|---|
| 3,638,215 | A | * | 1/1972 | Payne | 340/323 R |
| 3,727,213 | A | | 4/1973 | Kurtenbach | 340/323 |
| 3,729,216 | A | * | 4/1973 | Hahto et al. | 281/44 |
| 3,981,002 | A | * | 9/1976 | Gardner | 340/323 R |
| 4,045,788 | A | * | 8/1977 | Castelli et al. | 340/309.2 |
| 4,751,506 | A | * | 6/1988 | Brown | 273/DIG. 26 |
| 4,900,027 | A | * | 2/1990 | Sheridan | 273/292 |
| 5,039,977 | A | * | 8/1991 | Mele et al. | 273/371 |
| 5,294,913 | A | * | 3/1994 | Mower et al. | 116/222 |
| 5,307,055 | A | * | 4/1994 | Baskin et al. | 345/2.2 |
| 5,377,982 | A | * | 1/1995 | Villarreal, Jr. | 273/148 R |
| 5,418,517 | A | * | 5/1995 | Matherne et al. | 116/222 |
| 5,696,529 | A | * | 12/1997 | Evanicky et al. | 345/102 |
| 5,796,577 | A | | 8/1998 | Ouchi et al. | 361/68.1 |
| 5,894,261 | A | * | 4/1999 | Green | 273/371 |
| 5,898,587 | A | * | 4/1999 | Bell et al. | 340/323 R |
| 6,148,242 | A | * | 11/2000 | Descalzi et al. | 273/148 B |
| 6,262,698 | B1 | * | 7/2001 | Blum | 345/1.3 |
| 6,295,038 | B1 | * | 9/2001 | Rebeske | 345/1.1 |
| 6,504,706 | B2 | * | 1/2003 | Stewart | 361/681 |

FOREIGN PATENT DOCUMENTS

| | | |
|---|---|---|
| DE | 9416174 | 12/1994 |
| EP | 0787510 A | 8/1997 |
| WO | WO 98/52116 A1 | 11/1998 |

OTHER PUBLICATIONS

Communication pursuant to Article 96(2)—European Office Action dated Sep. 10, 2003.

* cited by examiner

*Primary Examiner*—Henry N. Tran
(74) *Attorney, Agent, or Firm*—Westerman, Hattori, Daniels, & Adrian, LLP

(57) ABSTRACT

A compact portable athletic data display apparatus, comprising a generally rectangular flat display section 3 which is rotatably connected at the lower end thereof with a generally rectangular flat control section 2 by means of hinges, so that the display section 3 may be held at upright position to display the data when it is used but folded onto the control section otherwise.

In operation, an operator stands up the display section 3 at the upright position, enter data to be displayed on the display section using data input keys. A monitor may be provided on the control section so that he may check on the monitor the data he has entered for display.

3 Claims, 11 Drawing Sheets

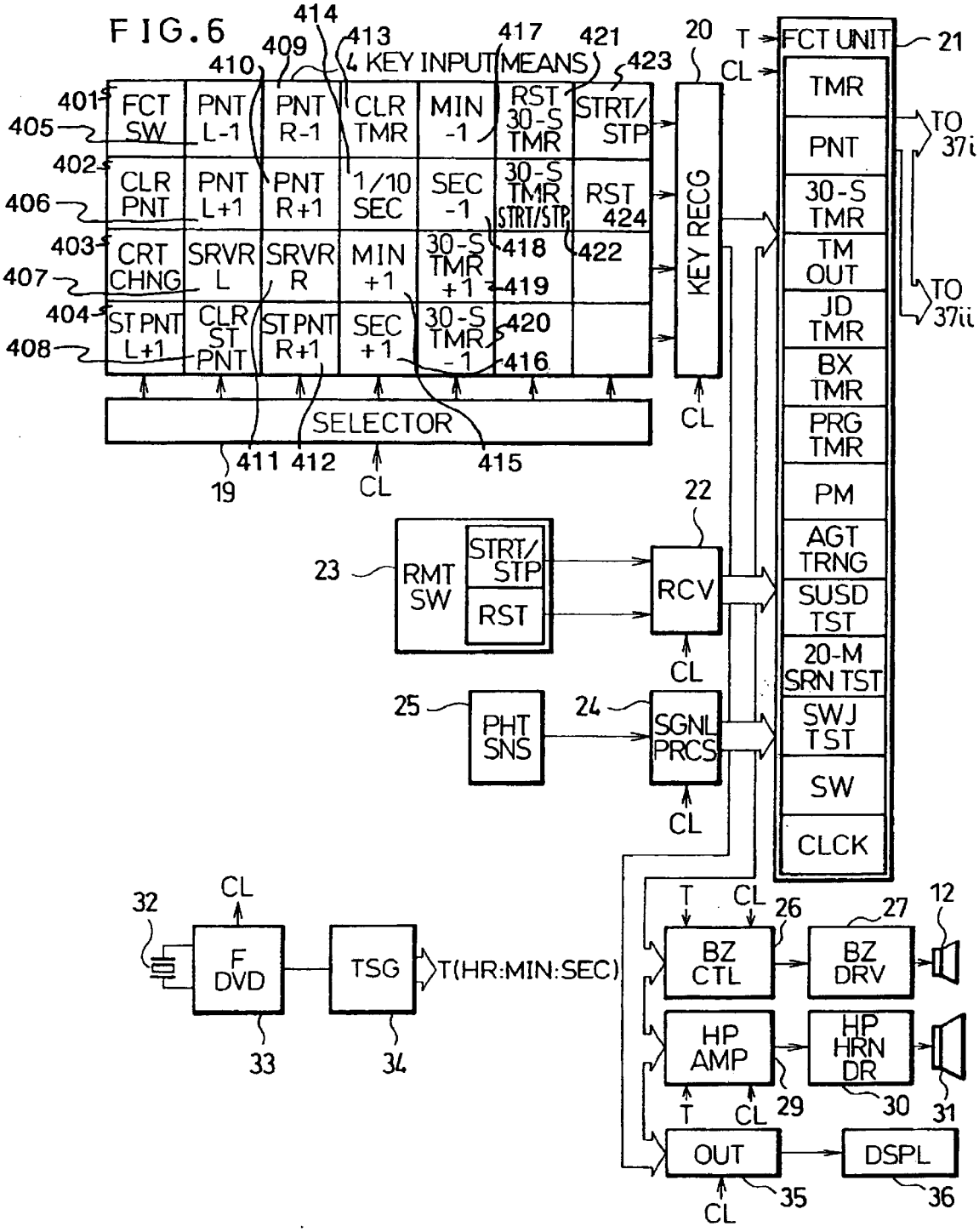
FIG.6
4 KEY INPUT MEANS
FCT SW
PNT L-1
PNT R-1
CLR TMR
MIN -1
RST 30-S TMR
STRT/STP
CLR PNT
PNT L+1
PNT R+1
1/10 SEC
SEC -1
30-S TMR STRT/STP
RST
CRT CHNG
SRVR L
SRVR R
MIN +1
30-S TMR +1
ST PNT L+1
CLR ST PNT
ST PNT R+1
SEC +1
30-S TMR -1
SELECTOR
KEY RECG
FCT UNIT
TMR
PNT
30-S TMR
TM OUT
JD TMR
BX TMR
PRG TMR
PM
AGT TRNG
SUSD TST
20-M SRN TST
SWJ TST
SW
CLCK
TO 37i
TO 37ii
RMT SW
STRT/STP
RST
RCV
PHT SNS
SGNL PRCS
F DVD
TSG
T(HR:MIN:SEC)
BZ CTL
BZ DRV
HP AMP
HP HRN DR
OUT
DSPL 200
401
FCT SW
RST ALL
BZ VLM HI/LOFF
CNT INTM OFF
CALL
OUT SW
BB PL TM TMR PNT/30-S TMR
PL TM TMR PNT/TM-OUT TMR
VB PNT ST PNT/TM-OUT TMR
JD PL TM TMR OS TMR
BX PL TM TMR RND
PRG TMR
PM
AGT TRNG
SUSD TST
20-M SRN TST
SWJ TST
SW
TMR
CLCK
BAT OFF
430
13
131
132
133
134
413
414
1st TMR
CNT UP/DWN
OUP ODWN
CLR
1MIN 1/10 SEC
OS TMR
MIN
SEC
416
+1
415
RYTHM
TEMP
-1
417
418
RST
424
423 STRT/STP
450
2nd TMR
SEC
419
+1
REP
-1
420
421
RST
422
STRT/STP
460
CRT CHNG
403
409 -1
+1 410
480 ST PNT
CLR
+1
404
408
412
470 SVR
407
411
PNT
CLR
402
-1 405
+1 406
440
7

DISPLAY APPARATUS FOR USE IN ATHLETIC GAMES

FIELD OF THE INVENTION

The invention relates to a display apparatus, and more particularly to a display apparatus suitable for displaying athletic data such as play time and game points of the teams in a basketball game.

BACKGROUND OF THE INVENTION

A typical display apparatus for use in gymnasiums is disclosed in Japanese Patent Early Publication 8-332255. This display apparatus has a feature that it is portable and that it may simultaneously display such pieces of information as players' ID numbers, ranks, points evaluated by judges, play time, and total game points which are useful especially in Karate matches. The display apparatus includes a body having a generally parallelepiped housing, a display board mounted on the housing, an upright support rod extending from the bottom of the housing, and a base for supporting the housing.

Although the above mentioned display apparatus is portable, it is difficult for a single person to transport the entire display apparatus by himself, since the apparatus has three large components, i.e. the housing, support rod, and the base.

The display apparatus has a further drawback that it is unable to provide a further timer to show a remaining period in a 30-seconds rule (a rule that a player must try a throw-in in 30 seconds) in a basketball game, which is needed in addition to the display for the two kinds of information (i.e. the game points and the remaining play time) in each half of the game. Therefore, an extra timer for the 30-seconds rule is needed, which extra timer causes, however, the players and the spectators to look at the two separate displays, thereby often disturbing them to concentrate on the game.

SUMMARY OF THE INVENTION

The invention can overcome aforementioned drawbacks of the prior art display apparatuses by providing an improved compact athletic data display apparatus which is portable and foldable when it is not used.

The invention is also directed to a convenient athletic data display apparatus suitable for a basket ball games.

In one aspect, an athletic data display apparatus of the invention comprises a generally rectangular flat control section having on one side thereof key input means, the control section that can be placed on a level place; and a generally rectangular flat display area having a display front for displaying athletic data such as predetermined play time and game points entered by said key input means, wherein the display area is rotatably connected with the control section by means of hinges and said display area is foldable onto said control section with its backside resting on the control section when said apparatus is not used.

In operation, an operator of the display apparatus places the control section on a desk, for example, and lifts up the display area to the upright position by rotating it about the hinges. The display front is then directed towards the players and the spectators, leaving the control section behind the display front. In order to show various athletic data on the display front to the players and the spectators, the operator may enter the data via the key-input means. The display front may be rotated about the hinge means through an arbitrary angle so that the display front can be set at the most convenient angular position for the players and the spectators to see it.

The control section may be provided thereon with an additional monitor for indicating the same athletic data as shown on the display front.

Thus, although the operator is unable to watch the data shown on the display front, he can confirm the data on the monitor, which helps him enter the data correctly. In addition, he can easily recognize development of the game by recognizing the remaining play time on the monitor.

The display front preferably has a first display area on the upper half of the display front, second display areas located at the right and left sides of the lower half of the display front, and a third display area between the second display areas.

In this arrangement, the first, the second, and the third display areas can individually display different types of data simultaneously so that the apparatus can be used as a versatile athletic data display apparatus capable of displaying a wide range of athletic data.

When it is used as a display apparatus for basketball games, it can show the play time elapsed on the first display area and game points on the second display areas. The third display area can be used as a 30-seconds rule timer.

In this manner, all of the three major elements of an athletic data in a basketball game, i.e. remaining play time, game points, and remaining time in a 30-seconds rule, can be shown on the same display front, thereby allowing the players and the spectators to look at the relevant data on the same display and grasp the game in a moment, without being distracted from an exciting play.

BRIEF DESCRIPTION OF THE DRAWINGS

FIG. 6 is a circuit diagram of a first drive circuit for use in a display apparatus of the invention.

DETAILED DESCRIPTION OF THE PREFERRED EMBODIMENT

Figure 1:
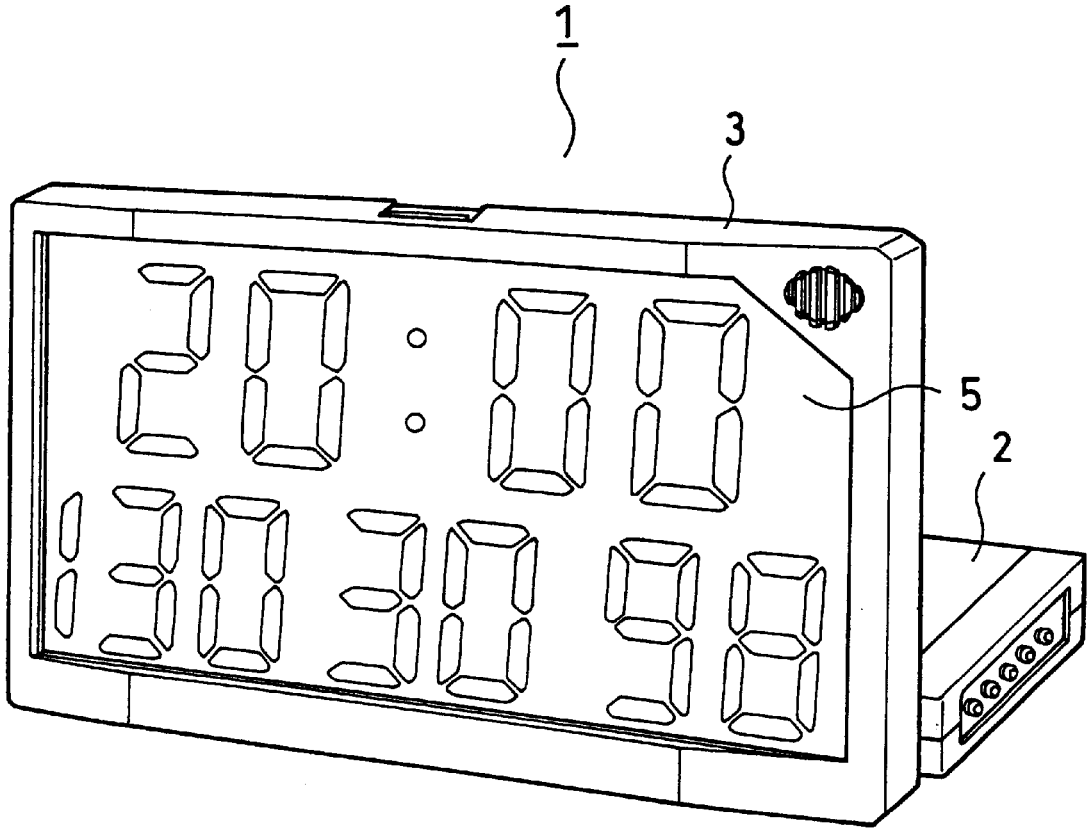
FIG. 1 is a perspective view of an athletic data display apparatus according to the invention, with its display front set at the upright position.
Figure 2:
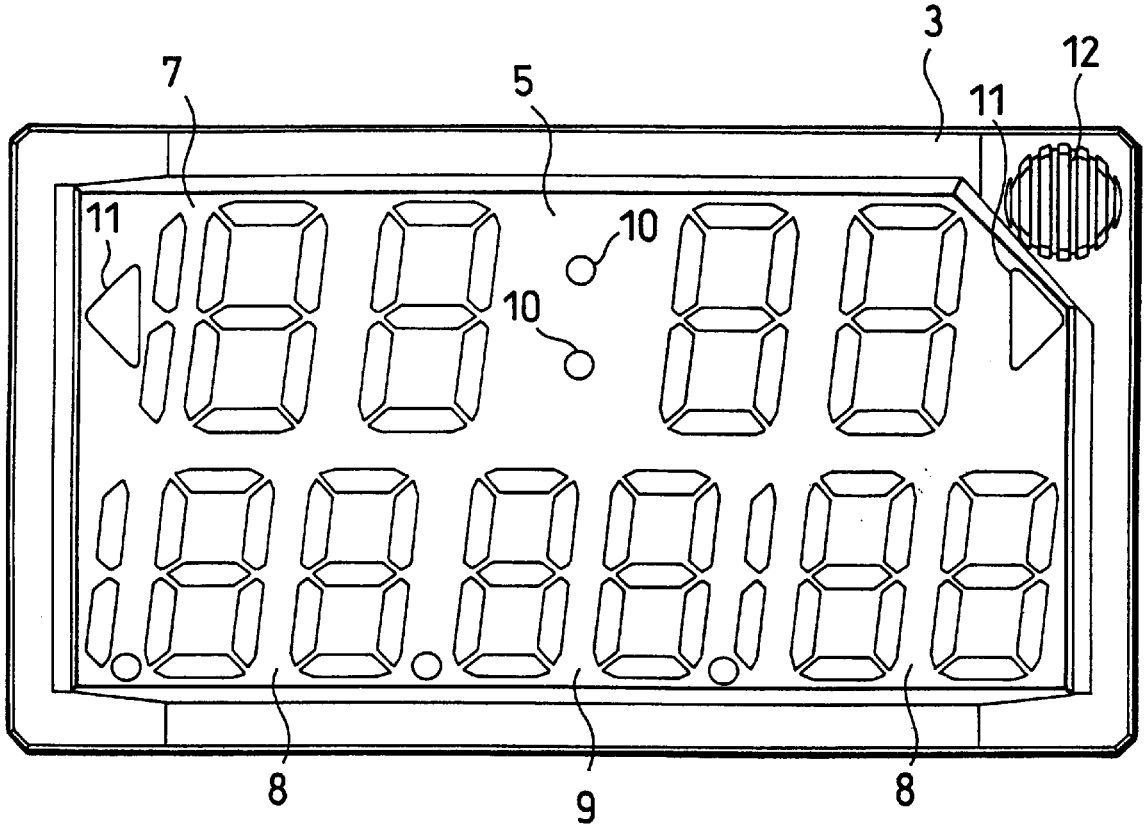
FIG. 2 is a front view of the display apparatus of FIG. 1.
Figure 3:
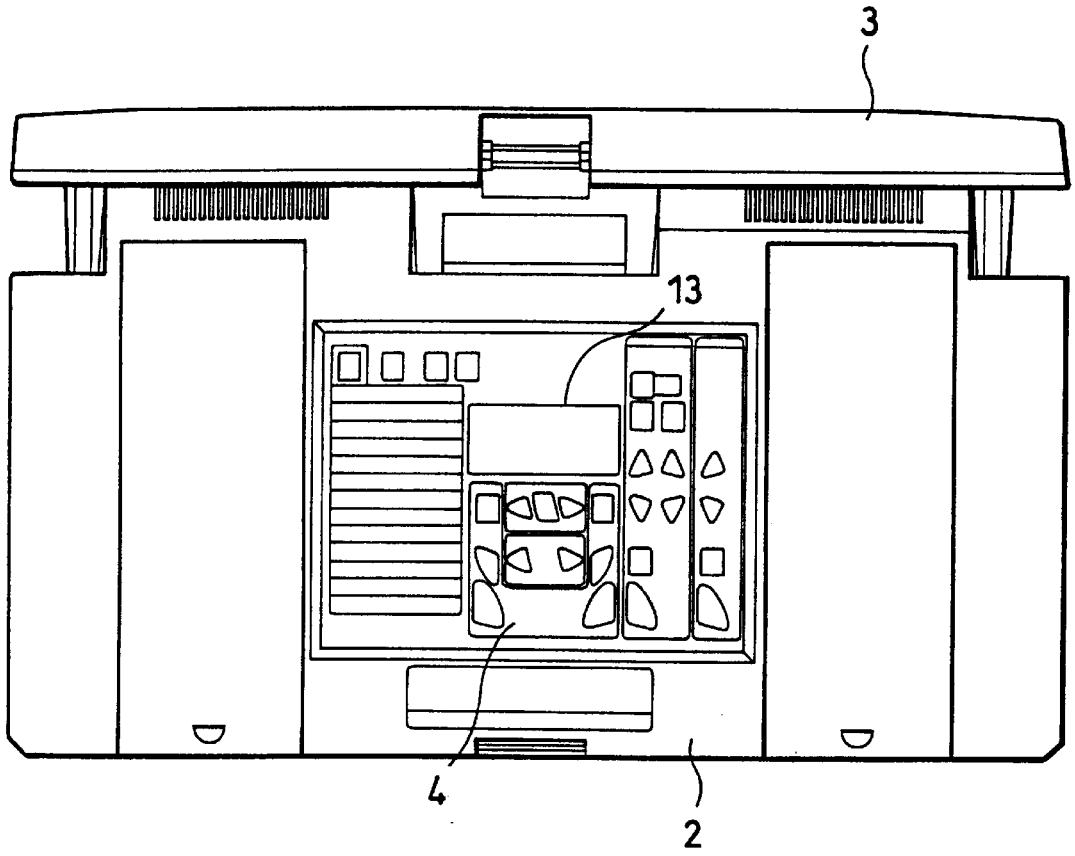
FIG. 3 is a top view of the display apparatus of FIG. 1.
Figure 4:
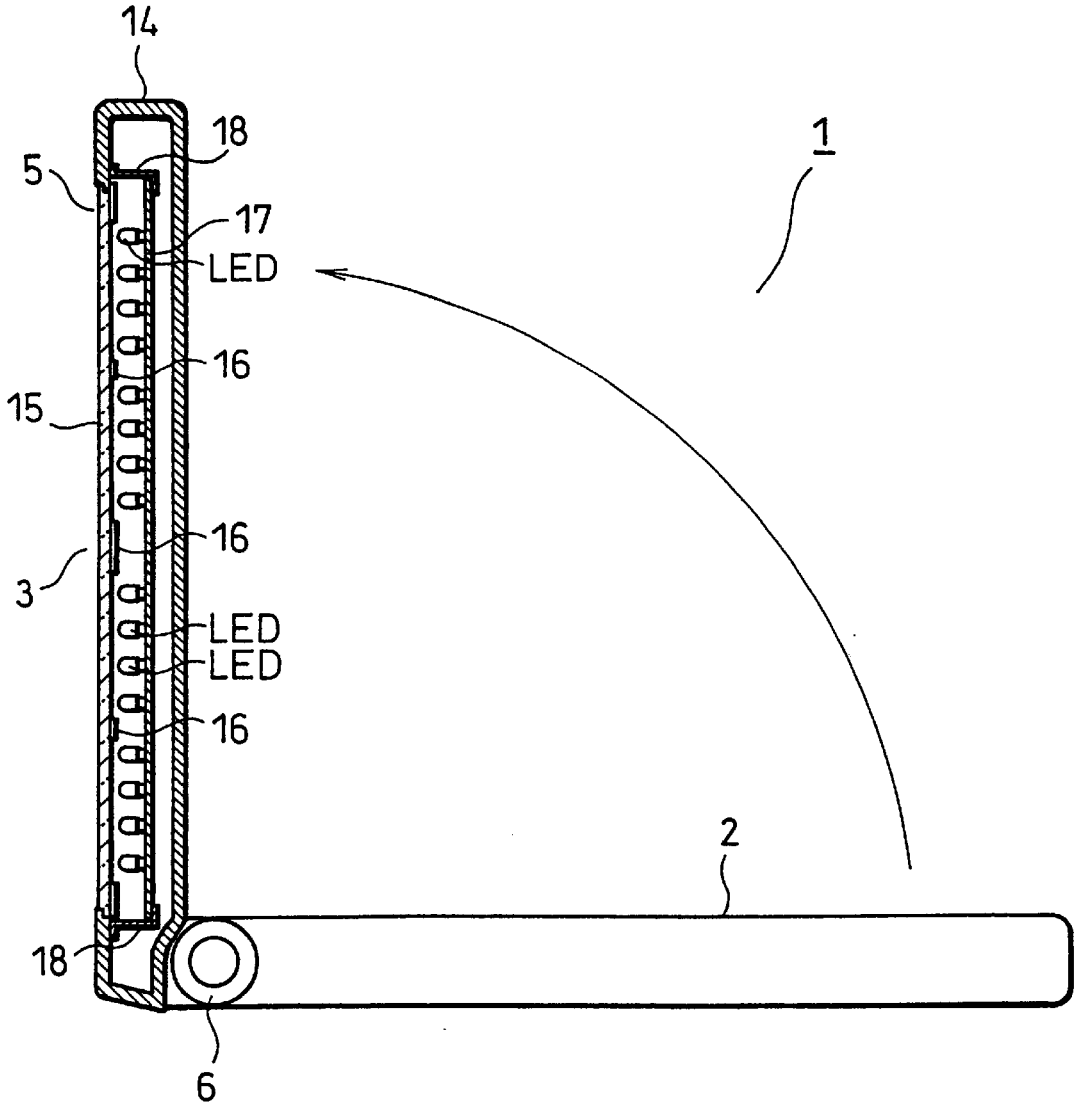
FIG. 4 is a side elevational view of the display apparatus of FIG. 1, with a display front shown in cross :section.
Figure 5:
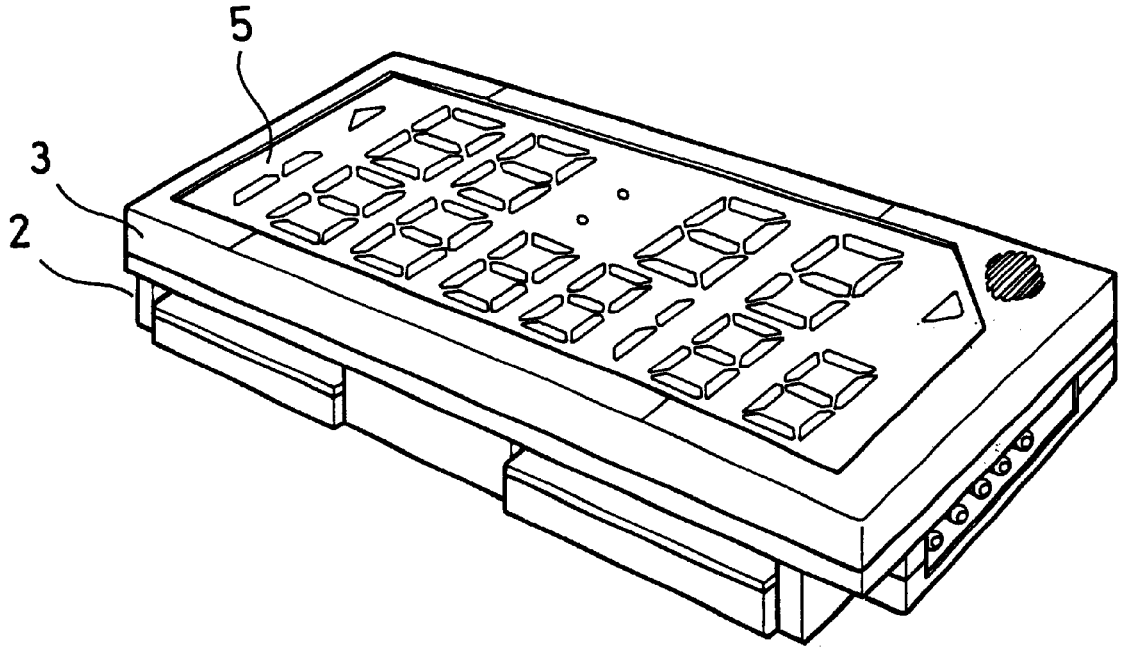
FIG. 5 is a perspective view of the display apparatus of FIG. 1, with the display section folded.

Referring now to FIGS. 1 through 5, there is shown an athletic data display apparatus 1 equipped with a control section 2 and a display section 3. The control section 2 has a generally flat rectangular configuration and has key-input means 4 arranged thereon. The control section 2 is designed to be held at a level position on a desk, for example, when it is used. The display section 3 also has a generally rectangular configuration, and has a display front 5 for displaying such data as play time and game points entered from the key-input means 4. The display section 3 is rotatably connected at the lower end thereof with the control section 2 by hinges 6. The hinges 6 can be separable ones, so that the display section 3: may be detached from the control section 2. FIGS. 1 and 4 show the display section put up at the upright position (when in use), while FIG. 5 shows the display section rotated or folded about the hinges until the display section is seated on the level control section 2 (when not in use). Such foldable arrangement of the display section is the same in nature as a display panel of a notebook type personal computer, except that the display front 5 of the display section of the apparatus is not encased when it is folded.

The display front 5 of the display section 3 is largely divided into an upper half and a lower half areas, as shown in FIG. 2. The lower display area includes three sub-areas (hereinafter referred to as left, central, and right area, respectively). The right and the left areas each have 3-digits, while the central area between them has 2-digits. The upper display area will be hereinafter referred to as the first display area 7; the right and the left 2-digit display areas in the lower half together as the second display areas 8, and the central display area as the third display area 9. The first display area 7 is intended to mainly display time (capable of displaying game points, too) and is divided by a colon 10 into left three digits and right two digits. A pair of triangular display elements 11 arranged on the opposite ends of the front 5 may indicate the team having a service in a volleyball game for example.

The second display areas 8 may indicate game points of the matching teams, and the third display area 9 may be used as a timer (hereinafter referred to as 30-seconds rule timer) for indicating remaining seconds in a 30-seconds rule. As noted previously, the 30-seconds rule is a rule in basketball games that a throw-in or shoot must be made within 30 seconds given to a player. However, the rule is sometimes changed to last for a shorter period of time (25 seconds, for example) in some countries and for women's games. In this specification, the term "30-seconds rule" is meant to apply to any of such rules.

Most of the digits of the display areas 7, 8, and 9 consist of a generally 8-shaped seven LED segments which are each consist of a multiplicity of LEDs. The display areas 7, 8, and 9 may have different colors to make them distinct from one another. For example, the first and the third display areas 7 and 9, respectively, may consist of red LEDs, while the second display area 8 may consist of yellow LEDs.

It should be understood that the LEDs may be substituted for by liquid crystal display elements, magnetic responsive elements, and EL (electroluminescence) elements. However, LEDs are more preferable to others for a display, since the brightness of the LEDs can be appropriately suppressed when it is used in a gymnasium, and enhanced when it is used outdoors. Provided at one corner of the display section 3 is a buzzer 12.

Figure 11:
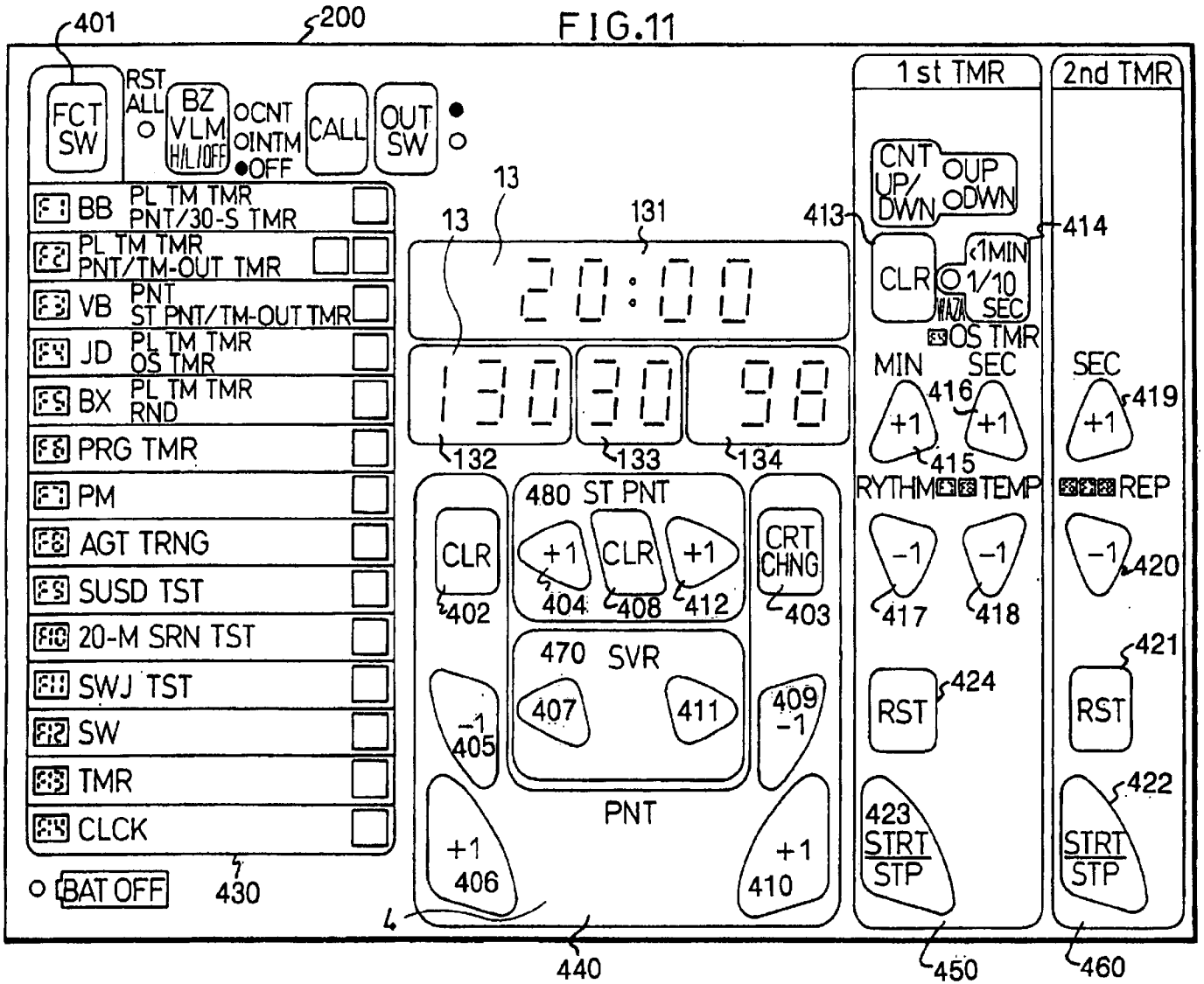
FIG. 11 is a plan view of the control section of the display apparatus, showing the arrangement of the various data input keys.

The control section 2 is provided with key-input means 4 for entering such athletic data as play time and game points, as shown in FIG. 3 and in more detail in FIG. 11. The key-input means 4 includes membrane-type key switches for changing the functions (hereinafter referred to as function keys), entering game points (game point keys), setting timers (timer setting keys), and controlling the output level of the buzzer.

By means of the function keys, relevant data for a particular game, as listed below, may be selectively displayed on the first through the third display areas. Types of data for different games will be described in detail with additional reference to FIG. 11.

Relevant Data Displayed on the Display Areas:

(a) Basketball (BB)

First display area 7: Play time (PL TM) (Count down in minute and second, starting from 20 minutes for a half time for example).

Second display area 8: Game points (PNT) for the matching teams.

Third display area 9: Remaining period for a 30-seconds Rule (Count down in second from "30").

(b) Handball, Kendo, Karate, Wrestling, and Fencing

First display area 7: Play time (PL TM) (set for each game).

Second display area 8: Game points (PNT) for the matching teams and/or players.

Third display area 9: Not used.

(c) Volleyball (VB)

First display area 7: Game points (PNT) for each team, displayed on the right and left two-digits areas separated by colon 10.

The current server may be displayed on the triangular display means 11 on the opposite sides.

Second display area 8: Current set point (ST PNT).

Third display area 9: Time-out time (TM-OUT TM) (Count down for a charged time-out time as defined by the rule).

(d) Judo (JD)

First display area 7: Play time (PL TM).

Example: Count down in second from "5:00".

Second display area 8: Numbers of "Waza-ari" (WAZA), "Yuhko" (YUHK), "Keikoku" (KEIK), "Shido" (SHID), etc.

Third display area 9: Osaekomi time (OS TM).

Example: Count up in second (two-digits) for every Osaekomi.

"25" seconds Osaekomi counts a point "Ippon".

(e) Boxing (BX)

First display area 7: Play time (PL TM).

Example: Count down in second from "3:00".

Second display area 8: Round (RND) (on the right area, for example).

Third display area 9: Not used.

(f) Programmed Timer (PRG TMR) (Sequential indications of programmed time and frequency of each entry).

First display area 7: Time (Count down in second (SEC) from a programmed time).

Second display area 8: Number of repetitions (REP) of a program (on the left area) and the entry number (on the right area).

Third display area 9: Not used.

(g) Pace Maker (PM) (for generating a prescribed pace making sound signal having a predetermined tempo (TEMP) and/or rhythm (RYTHM)).

First display area 7: Number of repetitions (REP) (three digits).

Second display area 8: Tempo (Frequency or Times per minute).

Example 1: Tempo "130/min" for example is shown on the left area when the tempo is set to "130", and "2-beat" rhythm on the right area when the rhythm is set to 2.

Third display area 9: Not used.

(h) Agility Training (AGT TRNG)

First display area 7: Preset number of repetitions (REP).

Second display area 8: Tempo (TEMP) (Frequency or Times per minute).

Example 1: Tempo "130/min" for example is shown on the left area when the tempo is set to "130", and "2-beat" rhythm on the right area when the rhythm is set to 2.

The first and the second displays 7 and 8 are turned off upon the beginning of the test. The right and the left one digit LEDs (four digits in total) are in turn randomly turned on and off, indicating to the player the directions of movements.

Third display area 9: Not used.

(i) Step-up-step-down Test (SUSD TST)

First display area 7: Test time and interval.

Example: Count down in second of each three-minutes tests and 1-minute intervals.

Second display area 8: Sign "STRT" on the left area indicating the start of pulse measurement, and subsequent interval on the right area.

Third display area 9: Not used.

(j) 20-meter Shuttle Run Test (20-M SRN TST)

First display area 7: Total shuttle runs.

Second display area 8: Sign "LEVEL" on the left area indicating the level of the test, and a number on the right area indicating the player's level.

Example: The player hears pace-making sounds while running 20 meters. The pace-making sound generates 8 sounds per a shuttle. The period of a shuttle decreases by one minute for every shuttle.

Third display area 9: Not used.

(k) Sideways Jump Test (SWJ TST)

First display area 7: Test time.

Example: Count down in second from 20 seconds say, while counting the total number of sideways jumps.

Second display area 8: Not used.

Third display area 9: Not used.

(l) Stop-watch (SW)

First display area 7: Time in minute and second.

Example: Count up of time in second, starting from "00:00".

Second display area 8: Count up in one-hundredth of a second in two digits (on the right display area, for example).

Third display area 9: Not used.

(m) Timer (TMR) (indicating a remaining period from a preset time)

First display area 7: Count down in second from "10:00" for example when the time is set for ten minutes.

Second display area 8: Not used.

Third display area 9: Not used.

(n) Clock (CLCK)

First display area 7: Current time in hour and minute.

Example: "10:50" if the time is 50 minutes after 10 o'clock.

Second display area 8: Seconds in two digits on the right area.

Example: "30" for 30 seconds.

Third display area 9: Not used.

Game point keys include:

(a) A set of "+1" key and "−1" key for each of the matching teams.

(b) "Clear" keys (CLR) for clearing the point of each team.

(c) "Service" keys (SVR) for displaying the team having a service, as in volleyball.

(d) A set of "Set Point" keys (ST PNT) consisting of "+1" keys and "Clear" key (CLR) for entering the number of sets the team won, as in volleyball.

(e) A "Court Change" key (CRT CHNG) for indicating a change of courts after the end of a set, as in volleyball game.

Timer setting keys are divided into two groups, one for the first display area 7 and another for the third display area 9. Each group includes: a set of "+1" key, "−1" key, and "Reset" key (RST) for setting "minute" (MIN) and "second" (SEC); "Start/Stop" key (STRT/STP) for starting/stopping the timer; "Count Up/Count Down" switching keys (CNT UP/DWN); and "1/10 Second" key (1/10 SEC) to show time in unit of one tenth of a second when a count down timer counts 59 second and less.

A monitor 13, located at a central area of the control panel, has three LED display areas associated with the first through the third display areas 7, 8, and 9, respectively, of the display section for indicating, on the monitor, the same data as these displayed on the display front. In operation, the operator may confirm the data he has entered and shown on the display panel 5 by looking at the monitor 13.

Figure 9:
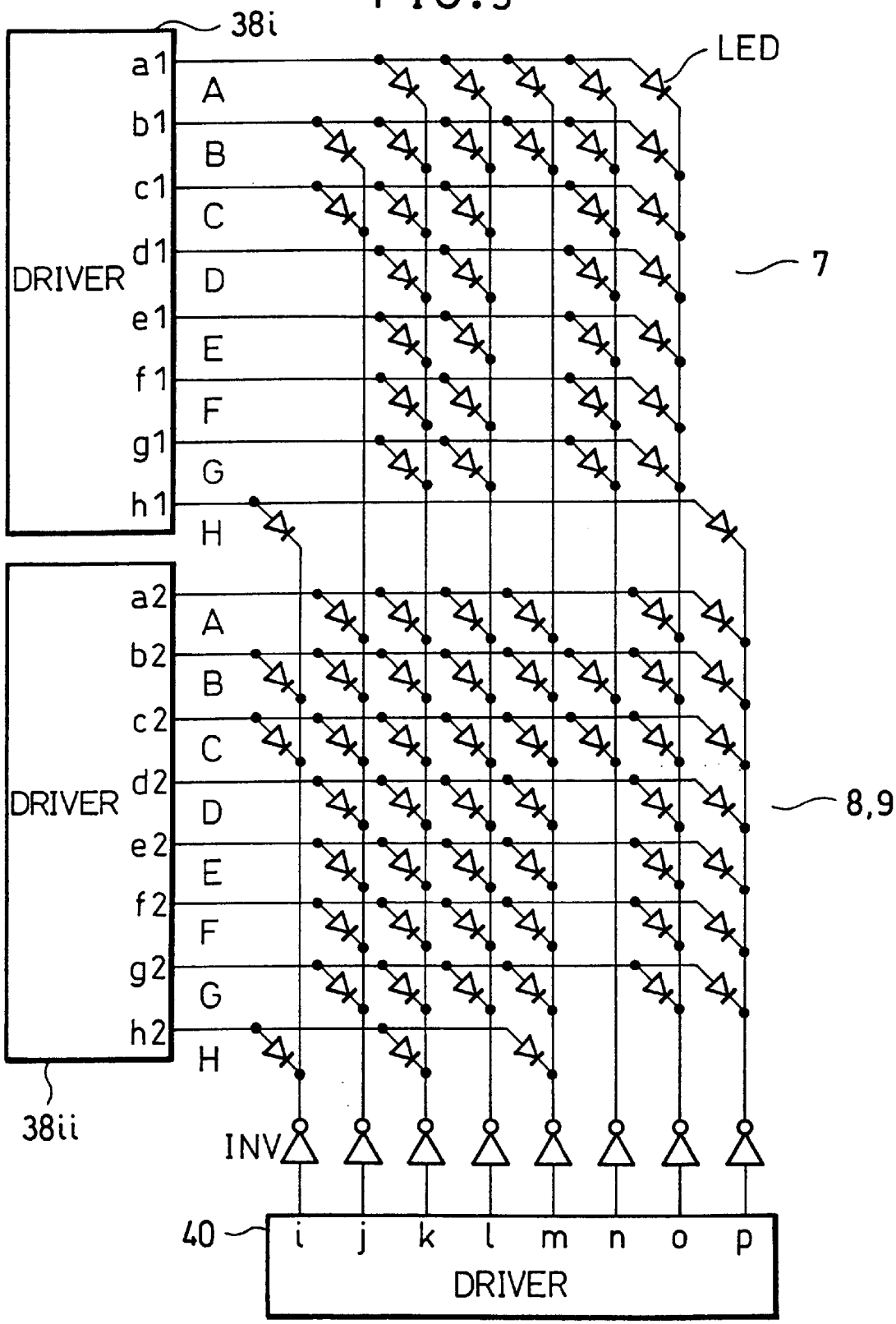
FIG. 9 is a circuit diagram of the display section.

Referring to FIG. 4, there is shown a structure of the display area 3. The display area 3 has a frame 14 which is made of a metal such as aluminum or a plastic, and a display front 15 which comprises a transparent acrylic resin or polyvinyl chloride resin, normally colored smoke brown (i.e. dark brown). Formed on the backside of the display front 15 is a shading layer 16 which permits transmission of light through 8-shape segment regions A, B . . . , and G (FIG. 9). The shading layer 16 helps to make the 8-shape segments outlined clearly, but is not indispensable.

A substrate 17 is located at a predetermined distance from the display front 15 in parallel therewith to hold a multiplicity of LEDs colored in red and yellow in the segments A, B . . . , and G. As described previously, those LEDs in the first and the third display areas 7 and 9, respectively, may have only red ones, and the LEDs in the second display area 8 may have only yellow ones. The number of LEDs in each segment constituting an 8-shape segment is four for example, and can be arranged in a row along the segment. Fixing members 18 are provided for securely holding the substrate 17 in position in the display apparatus 1. These LEDs are driven by secondary batteries (not shown) accommodated in the apparatus 1. The batteries can be removed from the apparatus 1, but they can be recharged as they are installed therein. Alternatively, an ac power source and dry cells may substitute for the secondary batteries.

A typical configuration and dimensions of a display apparatus of the invention as described above are as follows:

Control section 2: generally rectangular thin shape; Height-32 cm; Width-59 cm; Thickness-5 cm.

Display section 3: generally rectangular thin shape; Height-33 cm; Width-59 cm; Thickness-4 cm.

Total weight 5 kg (excluding batteries).

The overall thickness of the display area 3 and the control section 2 when the display area 3 is folded on the control section 2 is about 9 cm. The dimensions of such display apparatus are sufficiently small and the weight is light enough for a person to carry with him like an ordinary bag. The apparatus 1 preferably has latch means (not shown) for locking the display area 3 on the control section 2, and a handle for carrying the apparatus 1.

Figure 7:
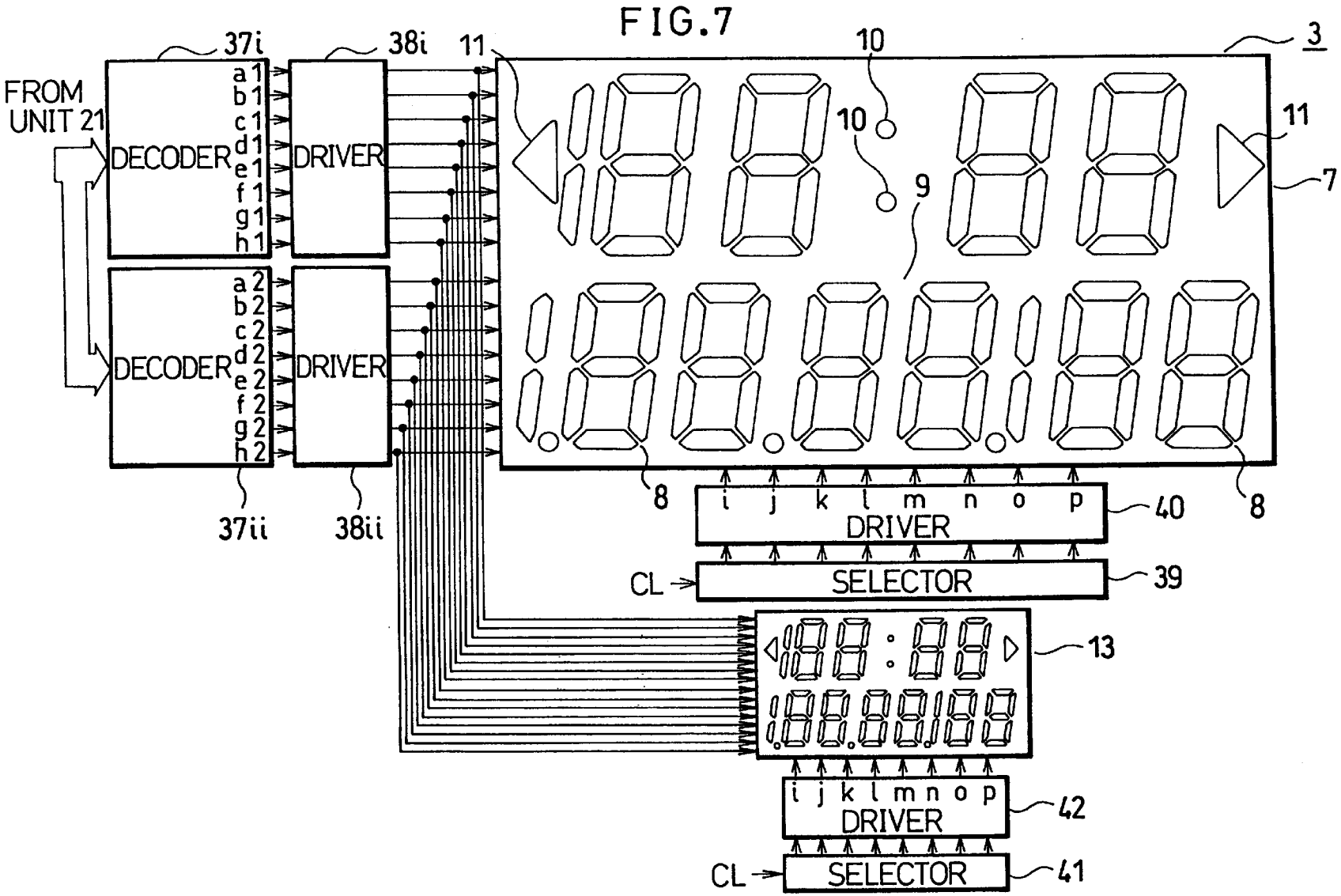
FIG. 7 is a circuit diagram of a second drive circuit which is operably connected with the first drive circuit of FIG. 6.

Referring to FIGS. 6 and 7, operation of the drive circuit of the apparatus will now be described. Aforementioned various types of keys 4 are arranged on the control section 2. A selector 19 is provided for selecting a particular type of keys. A key recognizer 20 indicates the key in operation. A function unit 21 may implement different functions, upon reception of signals from the key recognizer 20, such as a timer, a game point indicator, a 30-seconds rule timer, a time-out timer, a Judo timer, a boxing timer, a program timer, a pace-making timer, an agility training timer, a step-up-step-down test timer, a 20-meter shuttle run timer, a sideways jump test timer, a stopwatch, and a clock. It would be apparent that further functions may be added to the function unit 21 as needed.

A receiver 22 receives from a remote controller 23 infrared signals or wired signals for starting/stopping/resetting the timers. A set of photo sensors 25 are provided at a starting point and a goal point for sensing the start of each player and his arrival to the goal. The photo sensor 25 includes an infrared light emitting element and an infrared light receiving element to generate an optical signal. The optical signal of the sensor 25 is supplied to an optical signal processor 24, where the signal is converted to a signal indicative of the start or the arrival of the player to be indicated on the display.

Also provided on the control section 4 are a buzzer controller 26, a buzzer drive circuit 27 for energizing a buzzer 12 upon reception of a signal from the buzzer controller 26, and a high-power amplifier 29 for driving a horn driver 30 of a horn 31. A buzzer 12 is used for indoor games. The horn 31 is suited for use with outdoor games and some indoor games where a large number of spectators are watching the game. Further batteries may be implemented in energizing the horn 31. The control section also includes: a quartz oscillator 32, a frequency divider circuit 33 for dividing the frequency of the signals received from the quartz oscillator 32 to obtain signals CL for driving other components, a time-signal generator circuit 34 for generating time-signals T (indicative of hours, minutes, and seconds) upon reception of the signals from the frequency divider circuit 33. An output unit 35 of the apparatus 1 may supply the signals generated in the apparatus 1 to another display apparatus 36 (which is the same in structure as the apparatus 1), so that the data can be shown on the two display apparatuses.

Signals indicative of time, game point and other types of data are supplied from the function unit 21 to two decoders 37*i* and 37*ii* in the next stage, where they are converted into 8 segment signals, as shown in FIG. 7. The decoder 37*i* is adapted to supply segment signals a1, b1, c1, d1, e1, f1, g1, and h1 to the corresponding LEDs in the respective segments A, B, . . . , and H of the first display area 7, and the decoder 37*ii* is adapted to supply numerical segment signals a2, b2, c2, d2, e2, f2, g2, and h2 to the LEDs in the respective segments of the second and the third display areas 8 and 9, via respective drivers 38*i* and 38*ii*.

A selector 39, upon reception of a drive signal CL, generates eight digit signals i, j, k, 1, m, n, o, and p, which are sequentially output via a driver 40. These digit signals i, j, k, l, m, n, o, and p are synchronized with the segment signals a1, b1, . . . , and a2, b2, . . . . coming out of the drivers 38*i* and 38*ii*, respectively. They are input to the respective display segments in the display area 3. A selector 41, upon reception of a drive signal CL, outputs eight signals for driving the monitor 13. The monitor 13 are supplied with segment signals from the drivers 38i and 38*ii* and with eight digit signals i, j, k, l, m, n, o, and p from the driver 42 to energize corresponding LEDs of the monitor 13. A power supply needed to drive the entire circuit is not shown for simplicity of illustration.

Figure 8:
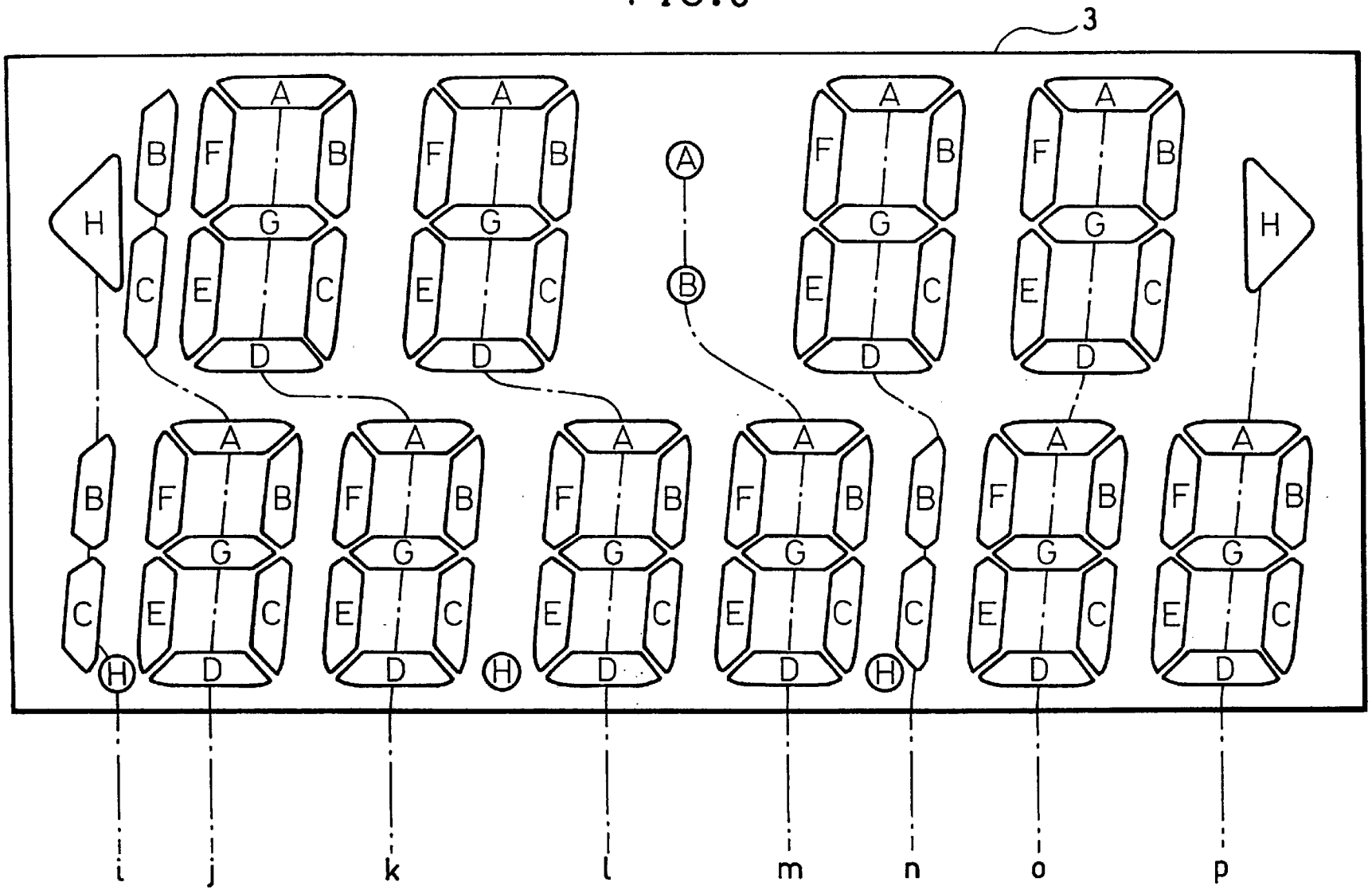
FIG. 8 shows the display front of the display section, useful in understanding various functions of the display apparatus.

Each of the LED segment A, B. . . . , and H, shown in FIGS. 8 is associated with an element of two 8×8 matrices, as shown in FIG. 9, so that the segments may be driven by the eight segment signals a1, b1 . . . . , and a2, b2 . . . . from the drivers 38*i* and 38*ii*, respectively and eight digit signal i, j, . . . . , from the driver 40. It could be understood that although the segment areas A, B . . . . , and H each has one LED in FIG. 9, they actually consist of multiple (e.g. 6) LEDs. For example, the segments A though G forming a part of character "8" consists of four LEDs. The segments representing a decimal point and the segments A and B representing a colon 10 consists of one LED, and a triangular segment H for indicating a server 11 consists of 6 LEDs. An inverter INV, shown in FIG. 9, inverts the signal it receives from the driver 40.

Figure 10:
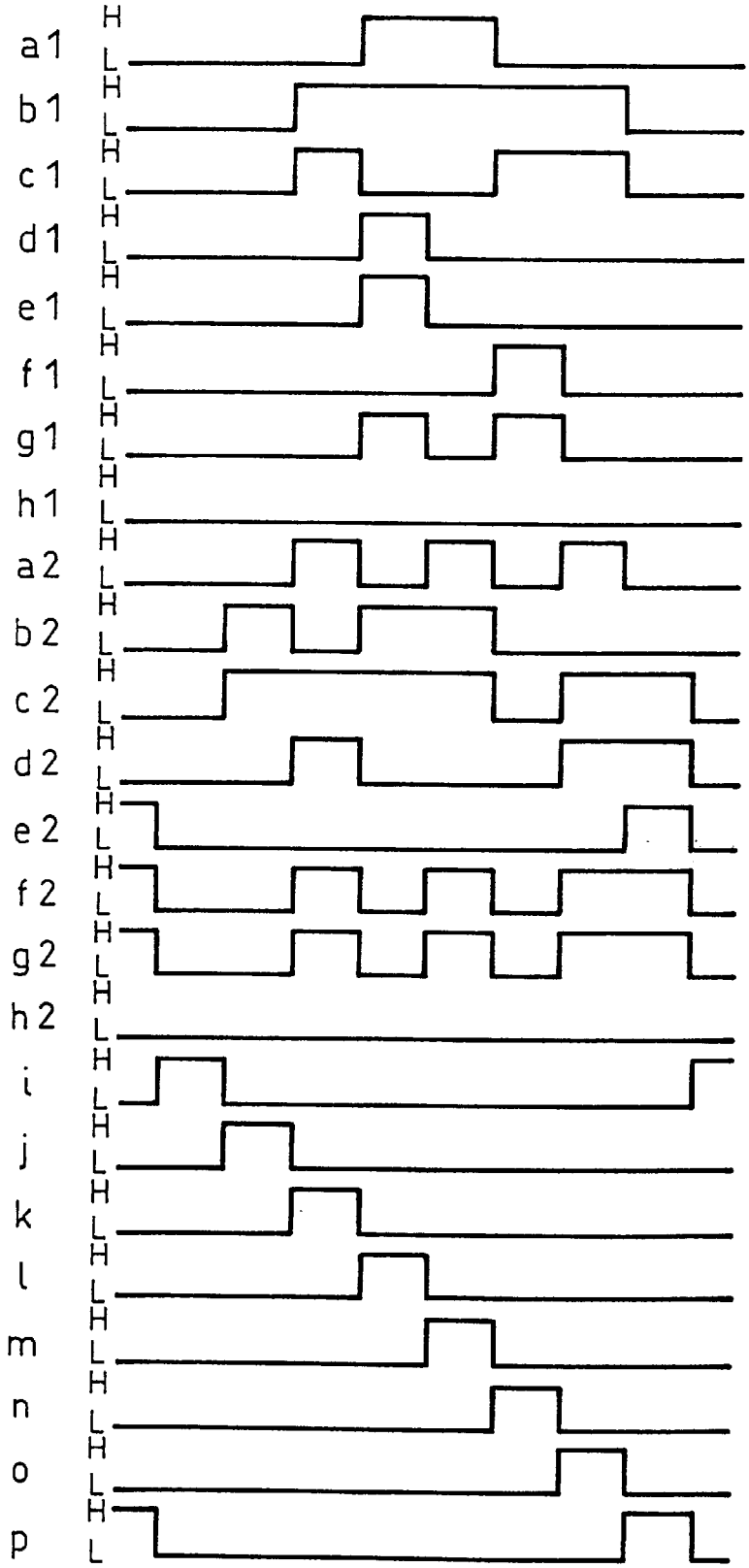
FIG. 10 is a timing chart for the signals appearing in the circuits, useful in understanding the behaviors of the circuits.

FIG. 10 illustrates typical waveforms of the signals indicative of athletic data of a basketball game, typically representing remaining play time as "12 minutes 41 seconds", game points as "15: 56", and remaining 30-seconds rule time as "19 seconds", which are displayed on the first through the third display areas 7, 8, and 9, respectively. In this manner, athletic game data is dynamically displayed with ⅛ duty cycle. In this arrangement, the major three pieces of data of a basketball game are simultaneously shown, so that the players and the spectators can instantly see the development of the game. Similar display can be obtained in other types of athletic games.

As shown in FIG. 11, the keys 401–424 of the key-input means 4 shown in FIG. 6 are arranged respectively in a function indicating area 430, a game point input area 440, a I st timer setting area 450, or a 2nd timer setting area 460, all of which areas are on a flat control face 200 of the control section 2.

In the embodiment shown in FIG. 11, functions F1–F14 indicated in the function indicating area 430 are sequentially switched (changed) by pressing down a FCTSW key 401. Respective functions F1–F14 are explained in items (a)–(n) hereinabove.

For example, when the FCTSW key 401 is pressed once, a function of "F1 : BB(Basketball) PL TM TMR(Play time Timer) PNT/30-S TMR(Game points/30-seconds Rule Timer)" is selected. When the key 401 is pressed twice, a function of "F2" is selected. The operator can confirm that the function "F1" has been selected, by looking at the indication of "F1" at the upper half section of a monitor section 13. In this case, by operating keys in the 1st timer setting area 450, the length of a game (e.g. "20:00") is set at the upper half section 131 of the monitor section 13. Then by operating keys in the 2nd timer setting area 460, the 30-seconds Rule is set on a display area 133 at the lower half section of the monitor section 13. After starting the game, by operating keys in the game point input area 440, the game points are entered into display areas 132, 134 respectively. Keys in two areas 470, 480 are used for volleyball games.

That is, when the operator selects a function by pressing the key 401, a game is selected. Then, it becomes possible to input data through keys corresponding to the selected game. The data input through the keys are held in a function unit 21 in FIG. 6, so that desired data such as remaining time, game points and the like are indicated at the desired display area in display style corresponding to the game. Since the function unit 21 is embedded in the control section 2, it is not shown in FIG. 11.

As described above, the function indicating area 430 on the flat control face 200 of the control section 2 merely indicates functions that a display apparatus according to the present invention can display. In the present invention, selection of a desired function is performed by operating (pressing) the key 401. However, it is conceivable that respective functions indicated in the function indicating area 430 may be directly selected.

In the claims:

1. A portable display apparatus for displaying athletic data, comprising a flat rectangular control section and a display section having a display screen on the front face thereof, wherein said display section is rotatably connected at the lower end thereof to said control section by hinges provided at the front end of said control section, said display section electrically connected to said control section, said display section and control section adapted to be opened and closed such that when opened said display section is erected with said display screen oriented forward;

said control section has a key input section on a flat control face of said control section, a functional section, and monitor section;

said functional section holds athletic data for multiple kinds of games;

said key input section has a plurality of keys for selecting athletic data, game points, and setting a timer;

said monitor section has a monitor screen for displaying the data displayed on said display section;

said display section is adapted to display, on the entire region of said display section, multiple kinds of athletic data to the players and spectators in an intelligible form.

2. The athletic data display apparatus according to claim 1, wherein said front face of said display section includes a first display area on the upper half section of said display front, second display areas located on the opposite sides of the lower half section of said display front, and a third display area located between said second display areas.

3. The athletic data display apparatus according to claim 2, arranged to display data of a basketball game such that said first display area indicates play time elapsed;

said second display areas indicates game points of the matching teams; and said third display area indicates remaining time in the 30-seconds rule time.

* * * * *